United States Patent [19]

Matsuki et al.

[11] Patent Number: 4,590,905

[45] Date of Patent: May 27, 1986

[54] PROCESS FOR DECOMPRESSION CONTROL IN INTERNAL COMBUSTION ENGINE AND APPARATUS THEREFOR

[75] Inventors: Ikuo Matsuki, Tokyo; Naoyuki Kamiya, Kawagoe; Toshimitsu Ikeda, Kiyose; Yoshiari Takagi, Yokohama; Yoshio Iizuka, Tsurugashimamachi; Yoshinobu Yamaguchi, Niiza; Hiroshi Funai, Asaka; Mutsumi Terasawa; Susumu Tasaka, both of Niiza, all of Japan

[73] Assignee: Honda Giken Kogyo Kabushiki Kaisha, Tokyo, Japan

[21] Appl. No.: 729,822

[22] Filed: May 2, 1985

[30] Foreign Application Priority Data

| | | | |
|---|---|---|---|
| May 4, 1984 | [JP] | Japan | 59-88353 |
| May 7, 1984 | [JP] | Japan | 59-89356 |
| May 7, 1984 | [JP] | Japan | 59-89357 |
| May 18, 1984 | [JP] | Japan | 59-98629 |

[51] Int. Cl.[4] ..... F02D 13/04

[52] U.S. Cl. ..... 123/321; 123/90.17

[58] Field of Search ..... 123/90.16, 90.17, 90.6, 123/321, 347, 198 F

[56] References Cited

U.S. PATENT DOCUMENTS

| | | | |
|---|---|---|---|
| 3,144,009 | 8/1964 | Goodfellow et al. | 123/90.17 |
| 3,439,662 | 4/1969 | Jones et al. | 123/321 |
| 3,516,394 | 6/1970 | Nichols | 123/90.17 |
| 4,314,408 | 2/1982 | Fenton | 123/90.17 |
| 4,453,507 | 6/1984 | Braun et al. | 123/90.16 |

*Primary Examiner*—William A. Cuchlinski, Jr.

*Attorney, Agent, or Firm*—Armstrong, Nikaido, Marmelstein & Kubovcik

[57] ABSTRACT

A process and apparatus for controlling the decompression of an internal combustion engine for driving compressors, electric generators, and the like, the process including the steps of starting the engine with the decompression control engaged and the engine decompressed, partially activating the control when the engine reaches a first predetermined speed so that, as the speed is increased, the engine operates compressed, when the engine reaches normal operating speed, fully activating the control and, when the engine speed is decreased to a second predetermined speed below said normal operating speed but above said first predetermined speed, the control is reactivated for decompression operation of the engine until the engine stops. The apparatus comprises a decompression weight and subsidiary decompression weight, pivotally mounted for movement by centrifugal force relative to the engine cam shaft and interconnecting means for interconnecting the weights when the engine is started and until the engine reaches a first predetermined speed, releasing the weights, one from the other, above such predetermined speed, and re-engaging the weights after the engine is stopped.

6 Claims, 21 Drawing Figures

PROCESS FOR DECOMPRESSION CONTROL IN INTERNAL COMBUSTION ENGINE AND APPARATUS THEREFOR

This invention relates to a decompression control process for use in an internal combustion engine for driving compressors, electric generators, and the like, and to apparatus for practicing such process in which one or more, but not necessarily all, of the cylinders of a multi-cylinder engine are decompressed by holding the exhaust valve of such cylinder open, or partially open, during decompression and allowing such exhaust valve to close in conventional manner during normal, or compression, operation.

Conventional processes for controlling decompression of internal combustion engines for driving compressors, generators, and the like, release the engine from a decompression condition in a predetermined engine speed range, when the engine is increased in running speed and return the engine to the decompression condition, in a predetermined engine speed range substantially equal to the foregoing speed range, when the engine is decreased in speed for stopping.

Such conventional process, however, has disadvantages, especially in a case where the predetermined engine speed range is set to be comparatively high, for instance, 1000–1200 r.p.m. At comparatively low engine speed, such as by increasing engine speed immediately after starting, the engine is still in a decompression condition with an output power which is comparatively small. These conditions do not meet required power for an output load. This can cause an accidental or unexpected stop of the engine, or, in other words, unreliable engine starting.

One method for overcoming the foregoing problem is to set the speed control range at a comparatively low engine speed. Such low speed control, however, has the disadvantage that, when the engine is being stopped, the engine is kept released from decompression, that is, in a compression condition. When the engine reaches the comparatively low speed range, dieseling can occur and prevent a good stopping operation.

This invention provides a decompression control process free from the foregoing disadvantages and is characterized in that the engine is released from the decompression condition, in a comparatively low engine speed range, after the engine is started and is increased in running speed, but is returned to the decompression condition, in a comparatively high speed range, when the engine is decreased in speed for stopping.

This invention, further, provides an apparatus for carrying out the foregoing decompression control process. In the apparatus of the invention, a camshaft of the engine, at at least one of the exhaust valve cam locations, is provided with a decompression cam and a decompression weight engaging the decompression cam so that when the engine is increased in speed for running, the weight may be moved outwardly against the action of a return spring by centrifugal force acting on the weight. The outwardly inclining weight turns the decompression cam to its inoperative side and releases the engine from its decompression condition. When the engine speed is decreased for stopping, the weight is moved inwardly by action of the return spring, causing the cam to turn to its operative side and return the engine to the decompression condition. In the apparatus of the invention, a subsidiary decompression weight is provided on the camshaft, separately from the foregoing decompression weight so that, when the engine is increased in running speed, the subsidiary decompression weight engages the decompression weight and moves integrally outwards therewith, by centrifugal force, as engine speed in increased to the running range. The engagement between the subsidiary decompression weight and the decompression weight is released, when the engine speed is decreased for stopping. The subsidiary decompression weight and the compression weight remain released until the engine is restarted.

The invention will be better understood from the following description taken with the appended drawings, in which.

Figure 1:
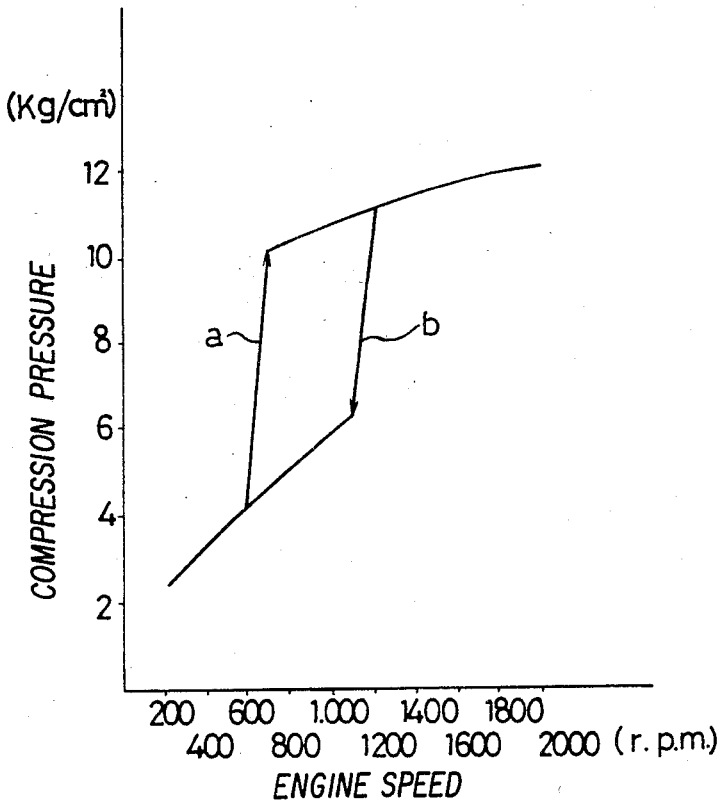
FIG. 1 is a diagram showing features characteristic of the operation in one example of this invention process.

Referring to FIGS. 2–7, camshaft 1, of an internal combustion engine, (not shown), has an exhaust valve cam 2, a driving gear 3 and a decompression cam 4 rotatable on shaft 5 on camshaft 1 so as to be positioned between valve cam 2 and gear 3, and decompression weight 6 which is in engagement with the cam 4 and is swingably supported, at its base portion, on supporting shaft 7 (FIGS. 3, 5–7) provided on one side of gear 3 so as to pivot outwardly against the action of return spring 8.

Figure 2:
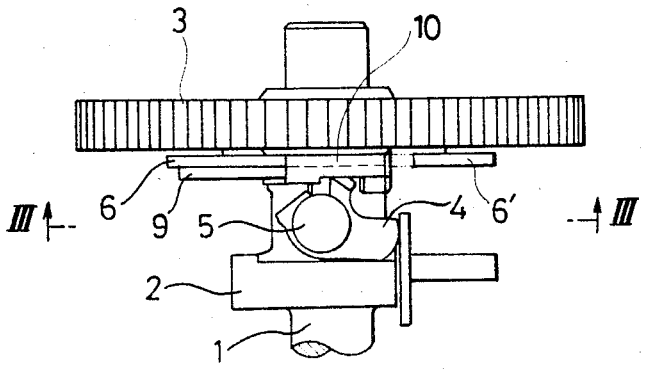
FIG. 2 is a top plan view of one embodying of the apparatus of the invention.
Figure 4:
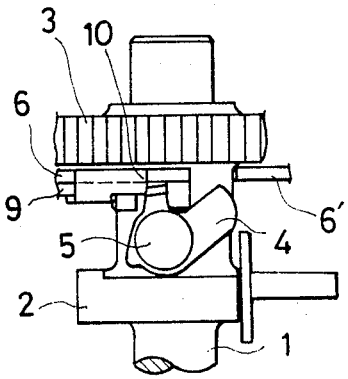
FIG. 4 is a top plan view, similar to FIG. 2, but showing the apparatus at low engine speed condition.

When the engine is increased in speed for running thereof, decompression weight 6 is pivoted outwardly, against the action of spring 8 by centrifugal force acting on the weight. Outwardly pivoting weight 6 moves decompression cam 4 to its inoperative side, away from exhaust cam 2, as shown in FIG. 4. The engine is then released from its decompression condition. When the engine is decreased in speed for stopping thereof, decompression weight 6 is pivoted inward by the action of spring 8, and decompression cam 4 is returned to its operative side, adjacent exhaust cam 2, as shown in FIG. 2. The engine is again in the decompression condition. In the illustrated example, a second decompression weight 6' is pivotally provided through a shaft 7' on a base portion thereof so as to be positioned on the other side of decompression weight 6, nearly symmetrically therewith. Spring 8 is connected, at its opposite ends, to decompression weights 6, 6', respectively.

In the foregoing apparatus, the decompression cams are moved into and out of inoperative position by the centrifugally actuated weights as the engine speed increases and decreases through substantially the same speed.

In this invention, when the engine is increased in speed for running, the decompression cam 4 is caused to turn to its inoperative side for releasing the engine from the decompression condition for compression operation at a comparatively low speed range, and when the engine is decreased in speed for stopping thereof, the decompression cam 4 is caused to turn to its operative condition for causing the engine to return to the decompression operating condition at a comparatively high speed range and until the engine stops.

The operational features characteristic of the process and apparatus of the instant invention are shown in FIG. 1. When the engine is increased in speed for running thereof, the engine is changed over from the decompression operating condition to compression operating condition in the comparatively low engine speed range of about 600 r.p.m., for instance, as shown by a line a in FIG. 1. The compression pressure of the engine is rapidly increased from about 4 $kg/cm^2$ to about 10 $kg/cm^2$. When the engine is decreased in speed for stopping thereof, the engine is changed over from compression operating condition to decompression operating condition, at the comparatively high engine speed range of about 1100 r.p.m., for instance, as shown by a line b in FIG. 1. The compression pressure of the engine is rapidly decreased from about 11 $kg/cm^2$ to about 6 $kg/cm^2$. The engine starting range with a recoil starter is set in the range, for instance, of 400–900 r.p.m.

To obtain the foregoing operation conditions, in the instant invention there is provided a subsidiary decompression weight 9, on the camshaft 1 in addition to the foregoing decompression weights 6, 6', so that when the engine is started and is increased in speed for running thereof, subsidiary decompression weight 9 is brought in engagement with decompression weight 6 so as to be moved to pivot outwardly integrally therewith. When the engine is further increased in speed to the practical running range of, for instance, 1200–1400 r.p.m., the engagement between the subsidiary decompression weight 9 and the decompression weight 6 is released. When the engine is, thereafter, decreased in speed for stopping, this released condition, that is, the disengagement condition, is maintained.

In one embodiment of the invention, shown in FIGS. 2–7, subsidiary decompression weight 9 is substantially coaxially with decompression weight 6. The two weights 6, 9 are arranged to be in engagement one with another through resilient hook 12 fixed to one of the two weights, for instance weight 6, for engagement with subsidiary decompression weight 9. Additionally, decompression weight 6 is provided with a receiving surface 11 for restricting the outward movement thereof to a predetermined amount so that when the engine is increased in speed to the operating range, the engagement between the two weights 6, 9 is released by a relatively further outward movement of subsidiary decompression weight 9 in relation to the decompression weight 6, restricted by the receiving surface 11 from further outward movement.

In the illustrated embodiment, the receiving surface 11 is so formed as to cooperate with the shaft 7' on the base portion of the other decompression weight 6, and the subsidiary decompression weight 9, and the other decompression weight 6', are kept in engagement one with another at engaging portions 9*a*, 6'*a* (FIG. 3), formed on their respective base portion ends, so that the two weights 9, 6' pivot in conjunction one with the other.

Figure 3:
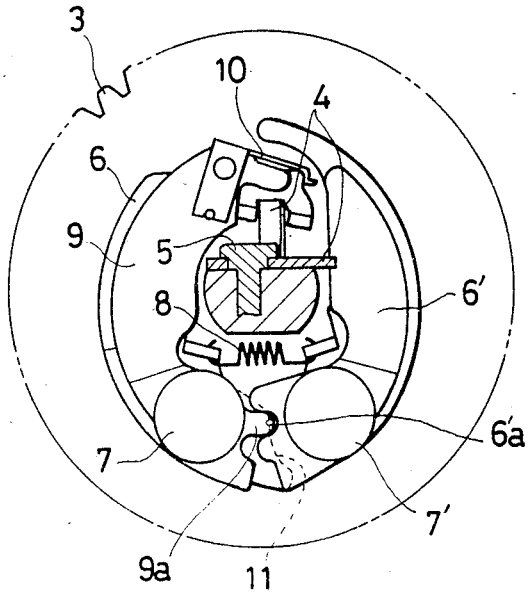
FIG. 3 is an enlarged sectional view taken along the line III—III in FIG. 2.
Figure 5:
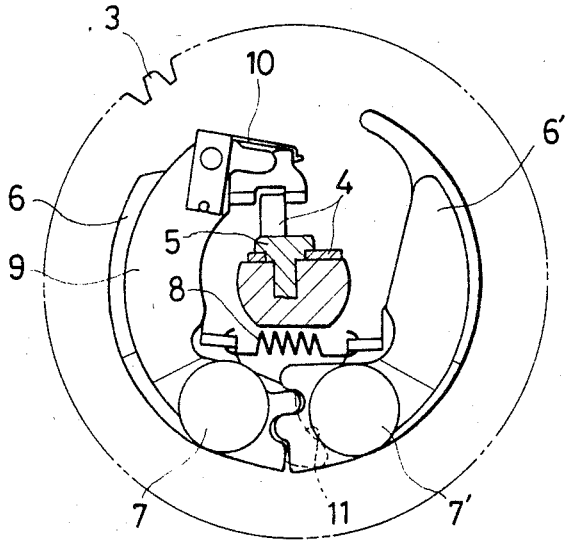
FIG. 5 is an enlarged sectional front view similar to FIG. 3 but showing the apparatus at a higher engine speed.
Figure 6:
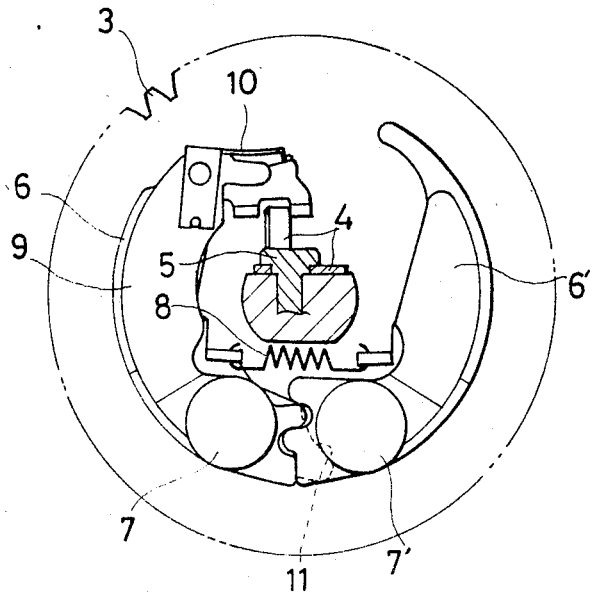
FIGS. 6 and 7 are sectional front views, similar to FIG. 3, at different operating speeds.

The operation of this embodiment is as follows:

When the engine is in its stop condition, the apparatus is in the condition as shown in FIGS. 2 and 3. Decompression weight 6 is in engagement with the subsidiary decompression weight 9 through hook 12 so as to be combined and become a comparatively large effective weight, and is urged inward with weight 9 and 6' by spring 8 to turn cam 4 to its operative side. Consequently, the engine is in its decompression operating condition. When the engine is started, for instance by a recoil starter, and is increased in speed, the apparatus takes the condition shown in FIGS. 4 and 5. Because decompression weight 6 and subsidiary decompression weight 9 interconnected by hook 12, and thereby effectively in a combined weight condition, the effective combined weight has a comparatively large centrifugal force and moves outwardly at a comparatively low engine speed range, for instance, around 600 r.p.m. As the result of such centrifugal force, the cam 4 is caused to turn to its inoperative side and the engine is released from the decompression condition as shown in FIG. 4 and operates in the compressed condition. When the engine is, thereafter, further increased in speed to the practical running range, for instance, around 1200 r.p.m., weight 6 is restricted in its outward movement by abutment of surface 11 with shaft 7', while weight 9 under further centrifugal force, is pivoted further outwardly, disengaging hook 12, and releasing weight 9 from weight 6 as shown in FIG. 5. Weight 6, thus released from its engagement with the weight 9, becomes a comparatively small effective weight.

Figure 7:
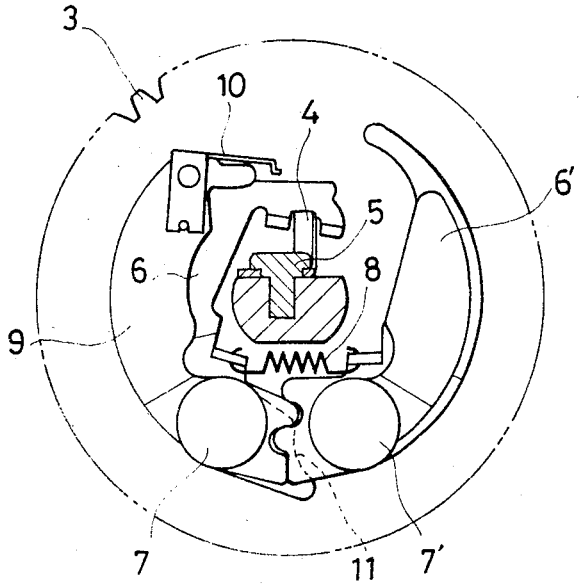

If, thereafter, the engine is decreased in speed for stopping, because weight 6 is at a relatively small effective condition and, accordingly, centrifugal force acting thereon is small, as shown in FIG. 7, weight 6 is moved inwardly by spring 8, at a comparatively high engine speed range, for instance, around 1100 r.p.m., and causes cam 4 to turn to its operative side, so that the engine is returned to the decompression operating condition. If, thereafter, the engine is further decreased in speed and stopped, the apparatus is returned to the condition shown in FIGS. 2 and 3 and prepared for the next operation.

FIGS. 8–13 show another embodiment of the apparatus of the invention.

A main difference thereof from the foregoing example is that, instead of the resilient hook 12, there is used a rigid material, hook 12' for engaging the decompression weight 6. Hook 12' is pivoted on the top end of subsidiary decompression weight 9 by shaft 13 and is movable outwards against the action of spring 14.

Figure 8:
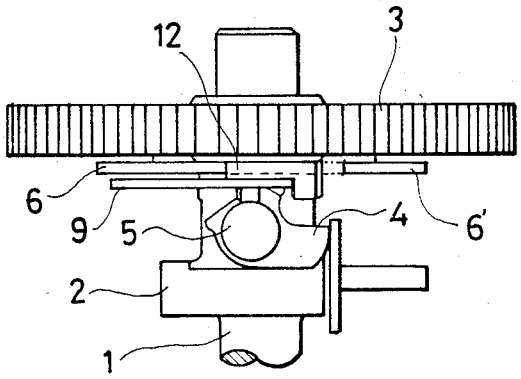
FIG. 8 is a top plan view of a second embodiment of the invention.
Figure 10:
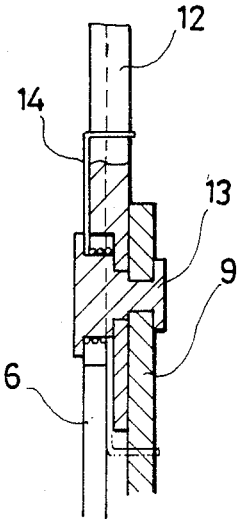
FIG. 10 is a sectional view taken along the line X—X in FIG. 9.
Figure 9:
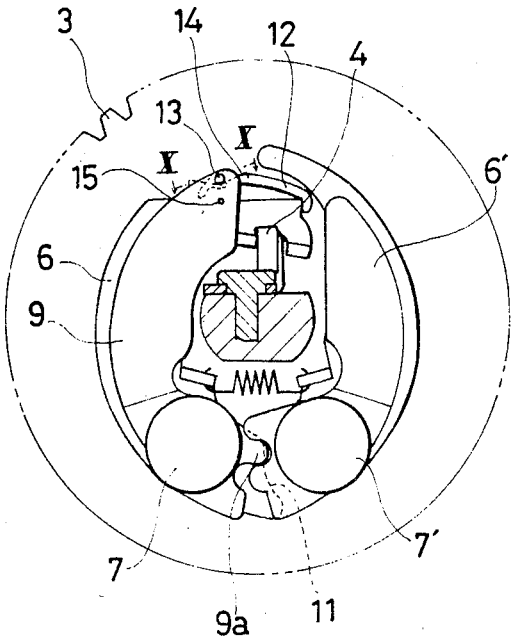
FIG. 9 is an enlarged sectional front view of the apparatus of FIG. 8.
Figure 11:
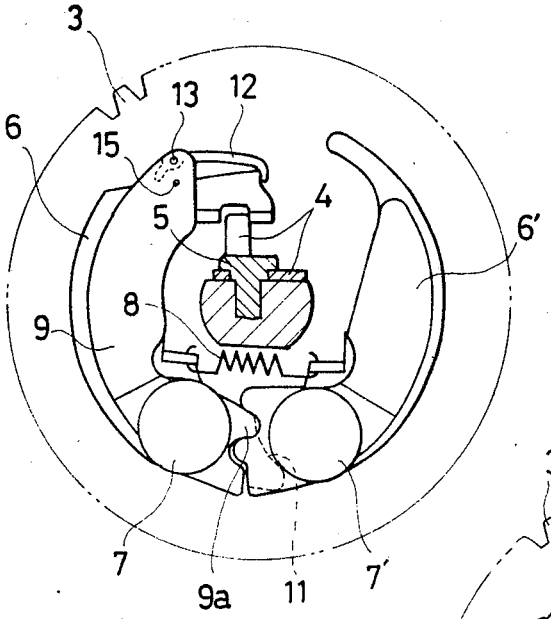
FIGS. 11–13 are sectional front views similar to FIG. 9, at different operating speeds.
Figure 12:
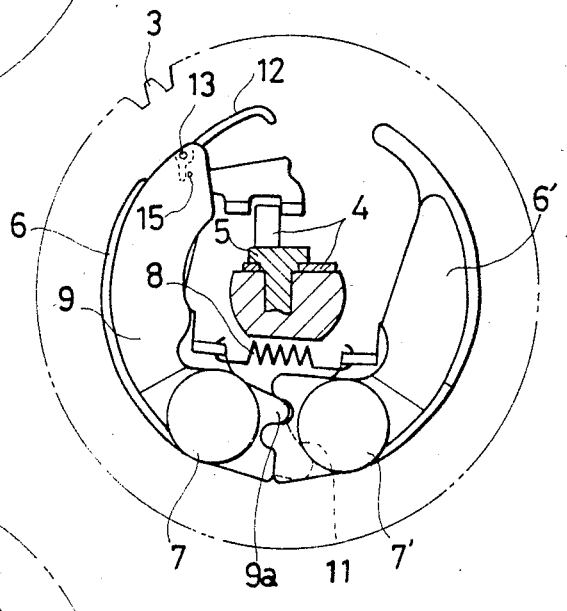
Figure 13:
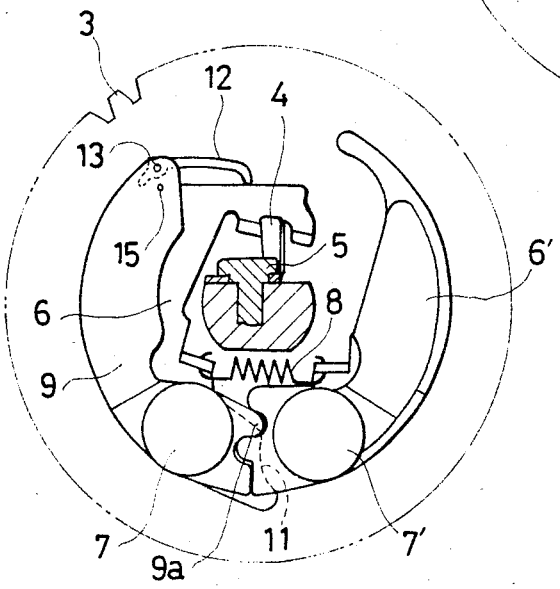

With this arrangement, when the engine is in a stopped condition, as shown in FIGS. 8 and 9, subsidiary decompression weight 9 and decompression weight 6 are kept in engagement one with another through hook 12. When the engine is increased in speed for running thereof, in almost the same manner as in the embodiment of FIGS. 2–7, decompression weight 6 is pivoted outwardly together with weight 9 at the foregoing comparatively low speed range. Thus, the engine is released from decompression operation and brought into compression operation condition, as shown in FIG. 11. If the engine speed is thereafter increased to the running speed, as shown in FIG. 12, hook 12' is moved outwardly against the action of spring 14 by centrifugal force acting thereon so as to release the engagement between weights 6, 9. Thereafter, when the engine is decreased in speed for stopping, the decompression weight 6 is moved to pivot inwardly by spring 8, in a comparatively high speed range. Thus, the engine is returned to the decompression operating condition as shown in FIG. 13.

In the embodiment of FIGS. 8–13, the decompression weight 6 is formed to have the receiving surface 11 for restricting the outward pivoted movement thereof in the same manner as in the embodiment of FIGS. 2–7. However, receiving surface 11 is not always necessary. Hook 12' may be provided on the decompression weight 6 rather than on subsidiary decompression weight 9. Numeral 15 denotes a stopper pin for restricting the outward inclination movement of hook 12' to a predetermined amount.

FIGS. 14–21 show a further embodiment of the invention. In such embodiments, FIGS. 15–21, shaft opening 16 is provided in the base portion of the decompression weight 6 to engage supporting shaft 7. Lower stage opening **16*a*, biased in position toward the end of the base portion of the weight 6, and an upper stage opening 16*b* connected with opening 16*a* so that the weight 6 may be pivoted, in an ordinary case, at such a lowered stage opening on the supporting shaft 7, or at its upper stage opening 16*b*. If the engine is increased in speed to the running range, weight 6 is changed over to the elevated position so that weight 6 is pivoted on the supporting shaft 7 at the lower stage opening 16*a*. Additionally, the subsidiary decompression weight 9 is pivotally supported on the supporting shaft 7 so that when the decompression weight 6 is at the lowered position, the two weights 6, 9 are in engagement, one with another, but when the decompression weight 6 is at the elevated position, the engagement between the two weights 6, 9** is released.

Figure 15:
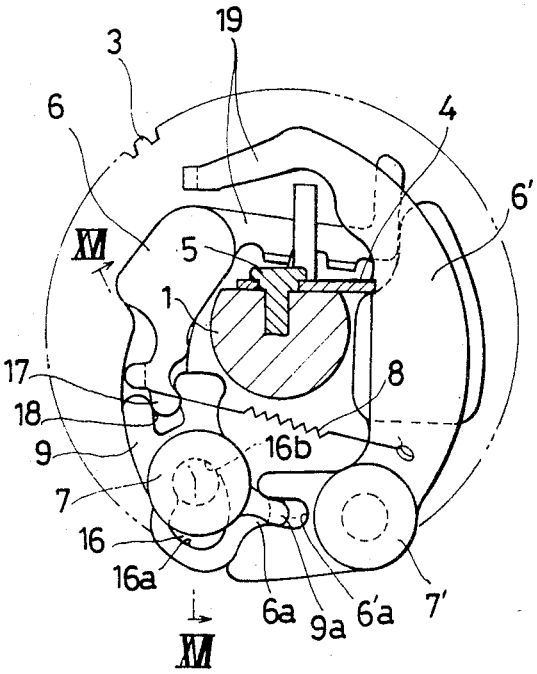
FIG. 15 is an enlarged sectional front view of the apparatus of FIG. 14.
Figure 16:
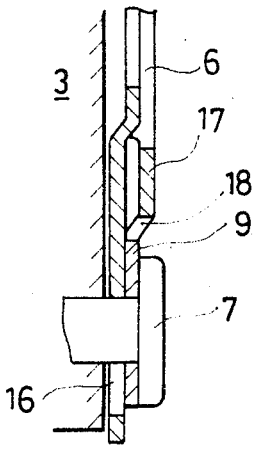
FIG. 16 is a sectional view taken along the lines XVI—XVI in FIG. 15, and FIGS. 17–21 are sectional front views, similar to FIG. 15, but at different operating speeds.

Additionally, in the illustrated example, engaging member 17, projecting downwardly, is fixed to a side surface of a middle portion of the decompression weight 6, and engaging groove 18, opening upwardly, is provided in the top end of subsidiary decompression weight 9 so that the two weights 6, 9 are detachably brought into engagement, one with another, in upper and lower directional relations through the engaging member 17 and engaging groove 18, as clearly shown in FIG. 16. Additionally, decompression weight 6, on one side, and weight 6', on the other side, are so arranged as to be engageable, one with another, at respective engaging arms 19, 19' projecting inwards from their respective top end portions, FIGS. 17–21. Decompression weight 6 is formed, at an end surface of the base portion thereof, with a cam surface **6*a*, FIGS. 15, 17–21, for cooperating with an engaging portion 6'*a* formed on an end surface of the base portion of the other side weight 6'**.

Figure 14:
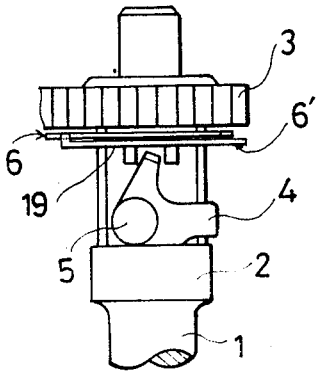
FIG. 14 is a top plan view of a third embodiment of the invention.
Figure 17:
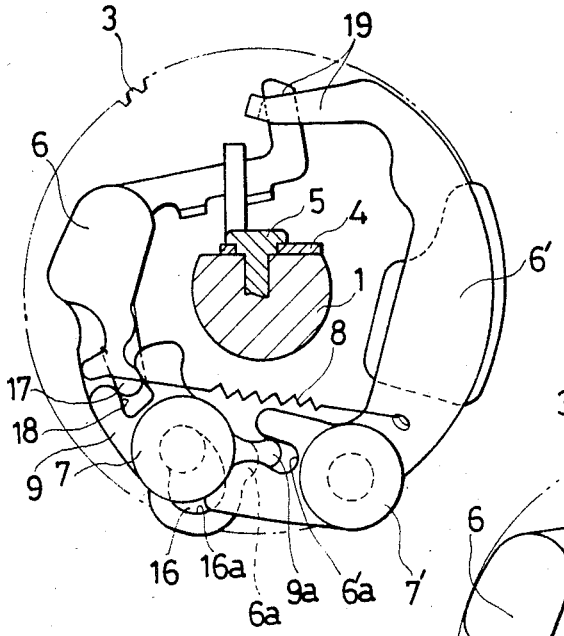
Figure 18:
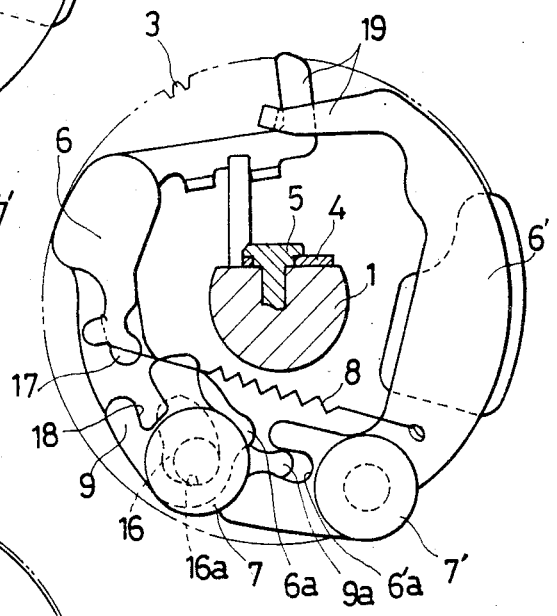

With this arrangement, when the engine is in its stop condition, the decompression weight 6, as shown in FIGS. 14, 15, is in the lowered position and is in engagement with the subsidiary decompression weight 9. If the engine is started and increased in speed for running, the decompression weight 6 is added with a centrifugal force acting on the subsidiary decompression weight 9 and is pivoted outwardly, against the action of spring 8, at a comparatively low engine speed range. The engine is brought to the decompression released condition as shown in FIG. 17 and, as the engine speed is increased, operates in the compressed condition. If, thereafter, the engine is further increased in speed to running speed condition, the apparatus shifts to the condition shown in FIG. 18. Namely, decompression weight 6, previously in position, is prevented from outward movement about shaft 7 by engagement of engaging arm 19 thereon with engaging arm 19 of the other side weight 6', as shown in FIG. 17. Other side weight 6' is slightly moved outwardly at its base portion side and is moved upwards as a whole. Thus, the weight 6 slides upwardly, at the shaft opening 16 on shaft 7 and is moved to such an elevated position that the lower stage opening **16*a* thereof is in abutment, at an inside edge thereof (a right side inner edge thereof in the drawings) with the shaft 7, and is further moved upwardly, at the engaging member 17, along the engaging groove 18 so as to come upwardly off therefrom, as shown in FIG. 18. Consequently, weight 6 becomes such a comparatively small effective weight and is in released condition with subsidiary decompression weight 9**.

Figure 19:
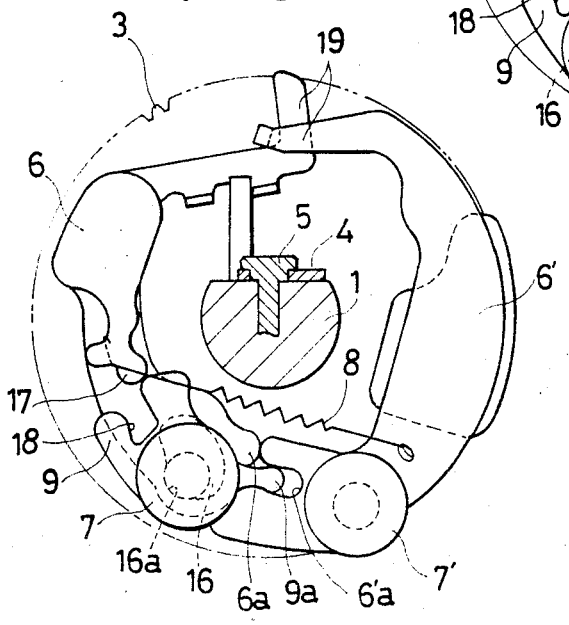
Figure 20:
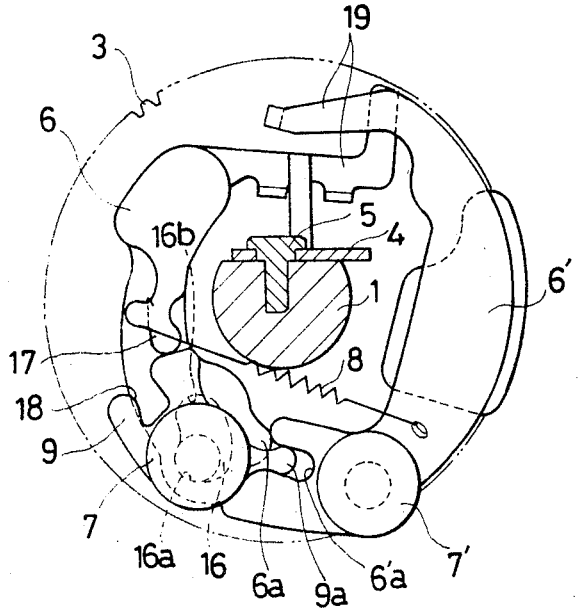
Figure 21:
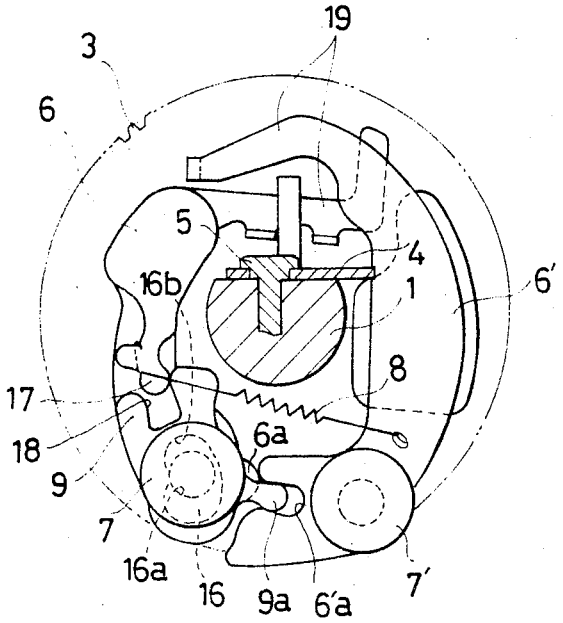

If, thereafter, the engine is decreased in speed, weight 6, as shown in FIG. 19, is slightly moved to pivot inwardly at the base portion side thereof and is brought in to position so that an outside edge (a left side inner edge) of the lower stage opening **16*a* is abutted with shaft 7. The engaging member 17 of weight 6 is moved inwardly at its position above the engaging groove 18. If the engine is further decreased in speed, since the weight 6 is previously released from engagement, with subsidiary decompression weight 9 and thus, has a comparatively small effective weight, as shown in FIG. 20, weight 6' is pivoted inwardly comparatively rigidly, that is, in a comparatively high speed, whereby the engine is returned to decompression operating condition. If the engine is further decreased in speed in succession thereto, the decompression weight 6, as shown in FIG. 21, is pivoted inwardly by the return spring 8 and subsidiary decompression weight 9 is pivoted inwardly in conjunction with the inward movement of the other side weight 6'. Additionally, the decompression weight 6 is pushed, at the cam surface 6*a*, by the engaging portion 6'*a* of the other side weight 6' to be pivoted slightly outward. Consequently, shaft opening 16 is moved to slide downwardly along shaft 7 and is brought into position so that the lower stage opening 16*b* becomes in alignment with shaft 7. At the same time, engaging member 17 is introduced into engaging groove 18 through the upper surface thereof for engagement therewith. If the engine is, then, stopped, the apparatus is returned to the condition shown in FIG. 15**.

Thus, according to this invention, the engine is released from its decompression condition, in a comparatively low engine speed for running, so that the engine can have a comparatively large power load requirements, and be prevented from an unexpected stop. Additionally, according to this invention, the engine is returned to its decompression condition, in a comparatively high engine speed range, when the engine is decreased in speed for stopping thereof, so that the engine can be stopped rapidly and reliably, and inconveniences of conventional apparatus are avoided.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A process for use in controlled decompression in internal combustion engine operation used for driving compressors, electric generator, and the like, comprising the steps of starting said engine with the decompression control engaged and said engine operating decompressed, increasing the speed of said engine with said decompression control engaged and said engine operating decompressed until said engine reaches a first predetermined speed, while increasing said engine speed above said first predetermined engine speed disengaging said decompression control to a first stage of disengagement to operate said engine compressed, while said engine is operating compressed, increasing said engine speed to an operating speed above said first predetermined speed and disengaging said decompression control to a second stage of disengagement while continuing to operated said engine compressed and, after said engine has completed said compressed operation with said decompression control disengaged, reducing said engine speed to a second predetermined speed above said first predetermined speed but below the operating speed, reengaging said decompression control and, with said engine operating decompressed further reducing the speed of said engine until said engine stops.

2. A process as recited in claim 1 wherein said first predetermined speed is an engine speed of about 600 r.p.m. and said second predetermined speed is an engine speed of about 1100 r.p.m.

3. In a decompression control apparatus in an internal combustion engine of the type that a camshaft of the engine is provided thereon with a decompression cam and a decompression weight engaging the cam so that when the engine speed is increased for running thereof, the weight is moved outwardly against the action of a return spring by centrifugal force acting on said weight, and said cam is turned to its inoperative side and released said engine from decompression operation, but when said engine speed is decreased, for stopping, the weight is moved inwardly by said return spring, and said cam is turned to its operative side and said engine is returned to decompression operation, the improvement comprising a subsidiary decompression weight pivoted at one of its ends to said camshaft, said subsidiary decompression weight being separate from said decompression weight but operational therewith when the speed is increased for the running of said engine, for engagement with said decompression weight and for outward movement integrally with said decompression weight and for release therefrom when the engine speed is increased to the operation speed.

4. In a decompression control apparatus, as recited in claim 3, wherein said subsidiary decompression weight is pivoted at one of its ends to said camshaft substantially coaxially with said decompression weight, and said weights are engaged, one with the other, by a resilient hook fixed to one of said weights and engaging the other of said weights and said decompression weight has a surface for restricting the outward movement of said decompression weight to a predetermined distance such that, when said engine speed is increased to the operation speed, said engagement between said weights by said hook is released by outward movement of said subsidiary decompression weight beyond the outward movement of said decompression weight restricted by said receiving surface.

5. In a decompression control apparatus, as recited in claim 3, wherein said subsidiary decompression weight is pivoted at one of its ends substantially coaxially with said decompression weight, to said camshaft and one of said weights is provided with a hook for engaging the other of said weight, said hook being pivotally movable outwardly, by centrifugal force, against the action of a spring, so that when the engine speed is increased to the normal engine running speed, the hook is moved outwardly against the action of said spring to thereby disengaging said two weights.

6. In a decompression control apparatus as recited in claim 3, wherein said decompression weight is pivotably supported, on a shaft opening at the base portion of said decompression weight, on a supporting shaft, said shaft opening having two stages comprising a lower stage opening near the end portion of said decompression weight and an upper stage opening above said lower stage away from said end but connected to said lower stage opening so that said decompression weight is normally pivoted at said lower stage but, when said engine speed is increased to said normal engine running speed, said pivot of said decompression is shifted to said upper stage, said subsidiary decompression weight being pivoted to said supporting shaft coaxially with said decompression weight so that said weights are brought into engagement one with another when said decompression weight is at the lower stage and said engagement is released when said engine speed is increased and said pivot of said decompression weight is shifted to said upper stage.

* * * * *